US010781684B2

(12) United States Patent
Wagner et al.

(10) Patent No.: US 10,781,684 B2
(45) Date of Patent: Sep. 22, 2020

(54) AUTOMATED DIRECTIONAL STEERING SYSTEMS AND METHODS

(71) Applicant: Nabors Drilling Technologies USA, Inc., Houston, TX (US)

(72) Inventors: Christopher Wagner, Poland, OH (US); Jesse Johnson, Cleveland, TX (US); Kenneth Barnett, Magnolia, TX (US); Austin Groover, Spring, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 260 days.

(21) Appl. No.: 15/603,784

(22) Filed: May 24, 2017

(65) Prior Publication Data

US 2018/0340406 A1 Nov. 29, 2018

(51) Int. Cl.

| | |
|---|---|
| ***E21B 47/024*** | (2006.01) |
| ***E21B 7/06*** | (2006.01) |
| ***E21B 44/00*** | (2006.01) |
| ***E21B 31/00*** | (2006.01) |

(52) U.S. Cl.

CPC ..... *E21B 47/024* (2013.01); *E21B 7/06* (2013.01); *E21B 31/005* (2013.01); *E21B 44/00* (2013.01)

(58) Field of Classification Search

CPC ..... E21B 47/024

See application file for complete search history.

(56) References Cited

U.S. PATENT DOCUMENTS

| | | | | |
|---|---|---|---|---|
| 6,050,348 | A | 4/2000 | Richardson et al. | |
| 7,802,634 | B2 | 9/2010 | Boone | |
| 7,823,655 | B2 | 11/2010 | Boone et al. | |
| 8,360,171 | B2 | 1/2013 | Boone et al. | |
| 8,510,081 | B2 | 8/2013 | Boone et al. | |
| 8,602,126 | B2 | 12/2013 | Boone et al. | |
| 9,290,995 | B2 | 3/2016 | Boone et al. | |
| 2006/0081399 | A1* | 4/2006 | Jones | E21B 7/04 175/61 |
| 2009/0090555 | A1* | 4/2009 | Boone | E21B 44/02 175/45 |
| 2015/0053482 | A1 | 2/2015 | Boone | |
| 2016/0116889 | A1* | 4/2016 | Zacharko | E21B 23/00 307/116 |
| 2016/0237802 | A1 | 8/2016 | Boone et al. | |

* cited by examiner

*Primary Examiner* — David J Bagnell
*Assistant Examiner* — Dany E Akakpo
(74) *Attorney, Agent, or Firm* — Haynes and Boone, LLP

(57) ABSTRACT

Apparatuses, methods, and systems are described herein for automating toolface control of a drilling rig. Such apparatuses, methods, and systems may change operating parameters of the drilling rig responsive to detected toolface orientations. Thus, if a toolface orientation of the drilling tool is determined to be outside an advisory sector, updated operating parameters may be determined and provided to the drilling tool. The updated operating parameters may change at least one of a clockwise rotation target or counterclockwise rotation target of the drilling tool.

20 Claims, 5 Drawing Sheets

AUTOMATED DIRECTIONAL STEERING SYSTEMS AND METHODS

FIELD OF THE DISCLOSURE

The present apparatus, methods, and systems relate generally to drilling and particularly to improved automated control of a toolface position of a drilling apparatus.

BACKGROUND OF THE DISCLOSURE

Underground drilling involves drilling a borehole through a formation deep in the Earth using a drill bit connected to a drill string. Two common drilling methods, often used within the same hole, include rotary drilling and slide drilling. Rotary drilling typically includes rotating the drilling string, including the drill bit at the end of the drill string, and driving it forward through subterranean formations. This rotation often occurs via a top drive or other rotary drive equipment at the surface, and as such, the entire drill string rotates to drive the bit. This is often used during straight runs, where the objective is to advance the bit in a substantially straight direction through the formation.

Slide drilling is often used to steer the drill bit to effect a turn in the drilling path. For example, slide drilling may employ a drilling motor with a bent housing incorporated into the bottom-hole assembly (BHA) of the drill string. During typical slide drilling, the drill string is not rotated and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running.

Directional drilling can also be accomplished using rotary steerable systems which include a drilling motor that forms part of the BHA, as well as some type of steering device, such as extendable and retractable arms that apply lateral forces along a borehole wall to gradually effect a turn. In contrast to steerable motors, rotary steerable systems permit directional drilling to be conducted while the drill string is rotating. As the drill string rotates, frictional forces are reduced and more bit weight is typically available for drilling. Hence, a rotary steerable system can usually achieve a higher rate of penetration during directional drilling relative to a steerable motor, since the combined torque and power of the drill string rotation and the downhole motor are applied to the bit.

A problem with conventional slide drilling arises when the drill string is not rotated because much of the weight on the bit applied at the surface is countered by the friction of the drill pipe on the walls of the wellbore. This becomes particularly pronounced during long lengths of a horizontally drilled bore hole.

To reduce wellbore friction during slide drilling, a top drive may be used to oscillate or rotationally rock the drill string during slide drilling to reduce drag of the drill string in the wellbore. This oscillation can reduce friction in the borehole. However, too much oscillation can disrupt the direction of the drill bit and send it off-course during the slide drilling process, and too little oscillation can minimize the benefits of the friction reduction, resulting in low weight-on-bit and overly slow and inefficient slide drilling.

The parameters relating to the top-drive oscillation, such as the number of oscillating rotations, are typically programmed into the top drive system by an operator, and may not be optimal for every drilling situation. For example, the same number of oscillation revolutions may be used regardless of whether the drill string is relatively long or relatively short, and regardless of the sub-geological structure. Drilling operators, concerned about turning the bit off-course during an oscillation procedure, may under-utilize the oscillation features, limiting its effectiveness. Because of this, in some instances, an optimal oscillation may not be achieved, resulting in relatively less efficient drilling and potentially less bit progression.

As such, drilling may be controlled through improved steering control systems. The steering control systems may provide steering corrections using reactive steering that may provide instructions based on toolface position and proactive steering based on differential pressure changes. Such steering corrections may be made by adjusting and/or offsetting a quill position of the drilling apparatus. However, under certain conditions, steering with quill position offsets may be ineffective under certain drilling conditions. Accordingly, improved automated steering control is needed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
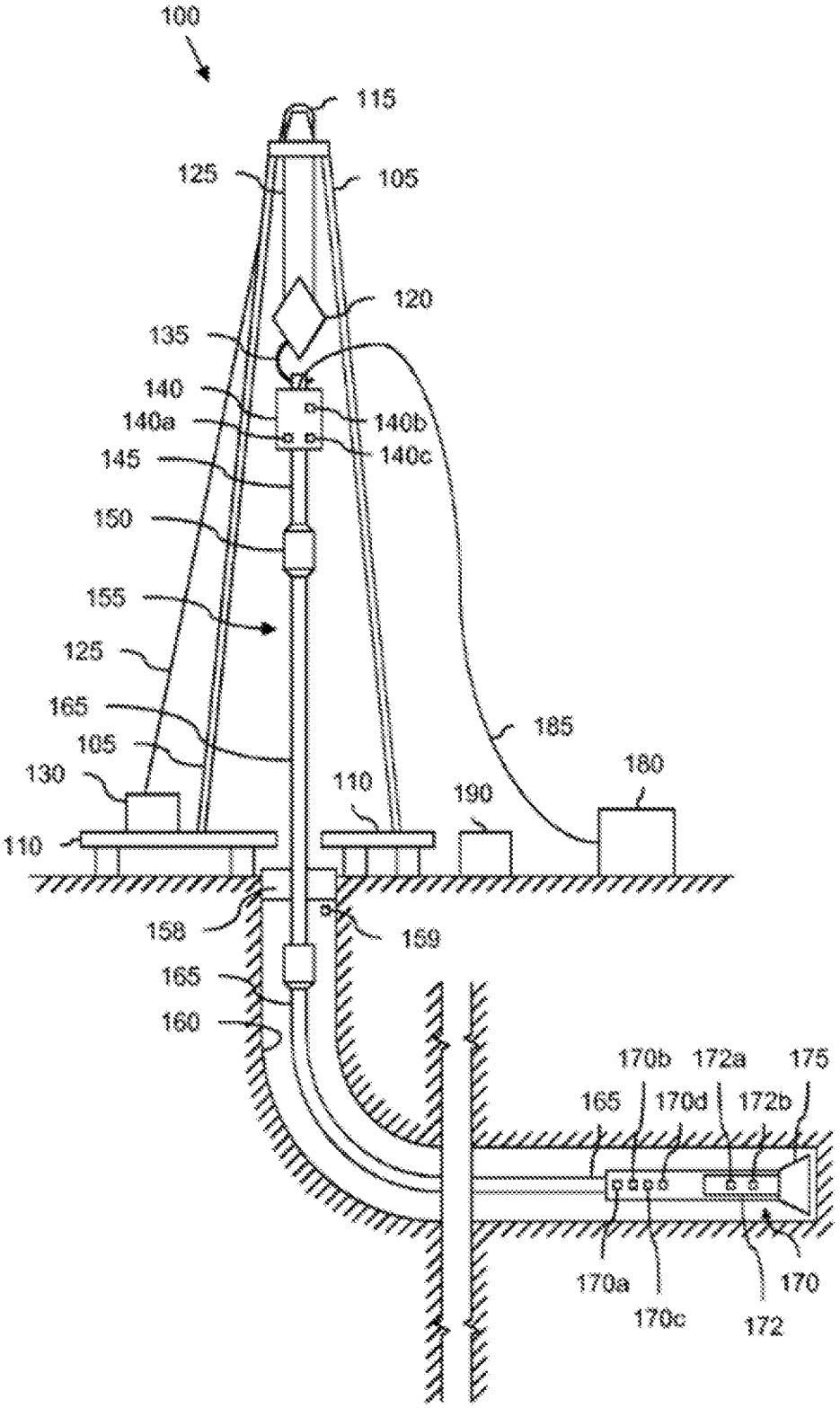
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

This disclosure provides apparatuses, systems, and methods for improved drilling efficiency by evaluating and determining an oscillation regime target, such as an oscillating revolution target, for a drilling assembly to reduce wellbore friction on a drill string while not disrupting a bit alignment during a slide drilling process. The apparatuses, systems, and methods allow a user (alternatively referred to herein as an "operator") or a control system to determine a suitable number of revolutions (alternatively referred to as rotations or wraps) and modify the number of revolutions to oscillate a tubular string in a manner that improves the drilling operation. The term drill string is generally meant to include any tubular string of one or more tubulars. This improvement may manifest itself, for example, by increasing the slide drilling speed, slide penetration rate, the usable lifetime of components, and/or other improvements. In one aspect, the system may modify the oscillation regime target, such as the target number of revolutions used in slide drilling based on parameters detected during rotary drilling. These parameters may include, for example, one or more of rotary torque, weight on bit, differential pressure, hook load, pump pressure, mechanical specific energy (MSE), rotary RPMs, and tool face orientation. In addition, the system may modify the oscillation regime target, such as based on one or more of the number of revolutions based on technical specifications of the drilling equipment, bit type, pipe diameters, vertical or horizontal depth, and other factors. These may be used to optimize the rate of penetration or another desired drilling parameter by maximizing the number of revolutions, which in turn reduces the wellbore friction along the drill string for a desired length of the drill string, while in one preferred embodiment not changing the orientation of the drill bit toolface during a slide.

In one aspect, this disclosure is directed to apparatuses, systems, and methods that optimize an oscillation regime target, such as the number of revolutions to provide more effective drilling. Drilling may be most effective when the drilling system oscillates the drill string sufficient to rotate the drill string even very deep within the borehole, while permitting the drilling bit to rotate only under the power of the motor. For example, a revolution setting that rotates only the upper half of the drill string will be less effective at reducing drag than a revolution setting that rotates nearly the entire drill string. Therefore, an optimal revolution setting may be one that rotates substantially the entire drill string without upsetting or rotating the bottom hole assembly. Further, since excessive oscillating revolutions during a slide might rotate the bottom hole assembly and undesirably change the drilling direction, the optimal angular setting would not adversely affect the direction of drilling. In another aspect, this disclosure is directed to apparatuses, systems, and methods that optimize an oscillation regime target, such as a target torque level while oscillating in each direction to provide more effective drilling. Therefore, a target torque level may be one that rotates substantially the entire drill string without upsetting or rotating the bottom hole assembly. An oscillation regime target is an optimal or suitably effective target value of an oscillation parameter. These may include, for example, the number of revolutions in each direction during slide drilling, the level of torque reached during oscillations during slide drilling, or the level of torque reached during previous rotation periods, among others.

The apparatus and methods disclosed herein may be employed with any type of directional drilling system using a rocking technique with an adjustable target number of revolutions or an adjustable target torque, including hand-held oscillating drills, casing running tools, tunnel boring equipment, mining equipment, and oilfield-based equipment such as those including top drives. The apparatus is further discussed below in connection with oilfield-based equipment, but the oscillation revolution selecting device of this disclosure may have applicability to a wide array of fields including those noted above.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

As depicted, the drill string 155 typically includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted to the surface. Data transmission methods may include, for example, digitally encoding data and transmitting the encoded data to the surface, possibly as pressure pulses in the drilling fluid or mud system, acoustic transmission through the drill string 155, electronically transmitted through a wireline or wired pipe, and/or transmitted as electromagnetic pulses. MWD tools and/or other portions of the BHA 170 may have the ability to store measurements for later retrieval via wireline and/or when the BHA 170 is tripped out of the wellbore 160.

In an exemplary embodiment, the apparatus 100 may also include a rotating blow-out preventer (BOP) 158, such as if the well 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 158. The apparatus 100 may also include a surface casing annular pressure sensor 159 configured to detect the pressure in the annulus defined between, for example, the wellbore 160 (or casing therein) and the drill string 155.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

The control system 190 is also configured to receive electronic signals via wired or wireless transmission techniques (also not shown in FIG. 1) from a variety of sensors and/or MWD tools included in the apparatus 100, where each sensor is configured to detect an operational characteristic or parameter. One such sensor is the surface casing annular pressure sensor 159 described above. The apparatus 100 may include a downhole annular pressure sensor 170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor 170*b* that is configured for detecting shock and/or vibration in the BHA 170. The apparatus 100 may additionally or alternatively include a mud motor delta pressure (AP) sensor 172*a* that is configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170 for sending data to the control system 190 that is indicative of the torque applied to the bit 175 by the one or more motors 172.

The apparatus 100 may additionally or alternatively include a toolface sensor 170*c* configured to detect the current toolface orientation. The toolface sensor 170*c* may be or include a conventional or future-developed "magnetic toolface" which detects toolface orientation relative to magnetic north or true north. Alternatively, or additionally, the toolface sensor 170*c* may be or include a conventional or future-developed "gravity toolface" which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block, drilling line or dead line anchor may additionally or alternatively include or otherwise be associated with a WOB sensor 140*c* (e.g., one or more sensors installed somewhere in the load path mechanisms to detect WOB, which can vary from rig-to-rig) different from the WOB sensor 170*d*. The WOB sensor 140*c* may be configured to detect a WOB value or range, where such detection may be performed at the top drive 140, draw works 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection equipment may include one or more interfaces which may be local at the well/rig site or located at another, remote location with a network link to the system.

Figure 2:
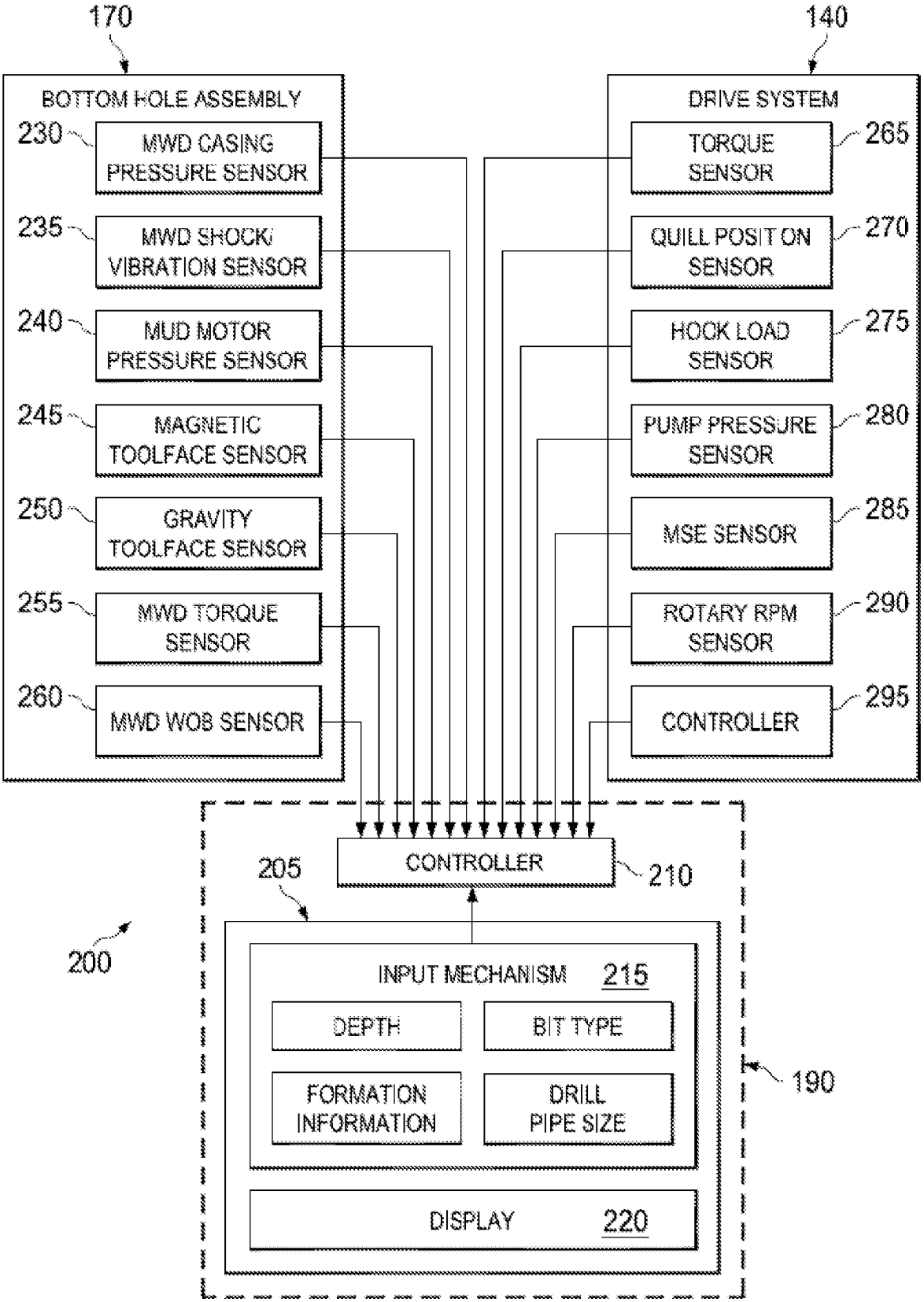
FIG. 2 is a block diagram schematic of an apparatus according to one or more aspects of the present disclosure.

FIG. 2 illustrates a block diagram of a portion of an apparatus 200 according to one or more aspects of the present disclosure. FIG. 2 shows the control system 190, the BHA 170, and the top drive 140, identified as a drive system. The apparatus 200 may be implemented within the environment and/or the apparatus shown in FIG. 1.

The control system 190 includes a user-interface 205 and a controller 210. Depending on the embodiment, these may be discrete components that are interconnected via wired or wireless technique. Alternatively, the user-interface 205 and the controller 210 may be integral components of a single system.

The user-interface 205 may include an input mechanism 215 permitting a user to input a left oscillation revolution setting and a right oscillation revolution setting. These settings control the number of revolutions of the drill string as the system controls the top drive (or other drive system) to oscillate a portion of the drill string from the top. In some embodiments, the input mechanism 215 may be used to input additional drilling settings or parameters, such as acceleration, toolface set points, rotation settings, and other set points or input data, including a torque target value, such as a previously calculated torque target value, that may determine the limits of oscillation. A user may input information relating to the drilling parameters of the drill string, such as BHA information or arrangement, drill pipe size, bit type, depth, formation information. The input mechanism 215 may include a keypad, voice-recognition apparatus, dial, button, switch, slide selector, toggle, joystick, mouse, data base and/or any other data input device available at any time to one of ordinary skill in the art. Such an input mechanism 215 may support data input from local and/or remote locations. Alternatively, or additionally, the input mechanism 215, when included, may permit user-selection of predetermined profiles, algorithms, set point values or ranges, such as via one or more drop-down menus. The data may also or alternatively be selected by the controller 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other techniques or systems available to those of ordinary skill in the art.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

In one example, the controller 210 may include a plurality of pre-stored selectable oscillation profiles that may be used to control the top drive or other drive system. The pre-stored selectable profiles may include a right rotational revolution value and a left rotational revolution value. The profile may include, in one example, 5.0 rotations to the right and −3.3 rotations to the left. These values are preferably measured from a central or neutral rotation.

In addition to having a plurality of oscillation profiles, the controller 210 includes a memory with instructions for performing a process to select the profile. In some embodiments, the profile is a simply one of either a right (i.e., clockwise) revolution setting and a left (i.e., counterclockwise) revolution setting. Accordingly, the controller 210 may include instructions and capability to select a pre-established profile including, for example, a right rotation value and a left rotation value. Because some rotational values may be more effective than others in particular drilling scenarios, the controller 210 may be arranged to identify the rotational values that provide a suitable level, and preferably an optimal level, of drilling speed. The controller 210 may be arranged to receive data or information from the user, the bottom hole assembly 170, and/or the top drive 140 and process the information to select an oscillation profile that might enable effective and efficient drilling.

The BHA 170 may include one or more sensors, typically a plurality of sensors, located and configured about the BHA to detect parameters relating to the drilling environment, the BHA condition and orientation, and other information. In the embodiment shown in FIG. 2, the BHA 170 includes an MWD casing pressure sensor 230 that is configured to detect an annular pressure value or range at or near the MWD portion of the BHA 170. The casing pressure data detected via the MWD casing pressure sensor 230 may be sent via electronic signal to the controller 210 via wired or wireless transmission.

The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal to the controller 210 via wired or wireless transmission.

The BHA 170 may also include a mud motor AP sensor 240 that is configured to detect a pressure differential value or range across the mud motor of the BHA 170. The pressure differential data detected via the mud motor AP sensor 240 may be sent via electronic signal to the controller 210 via wired or wireless transmission. The mud motor AP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface. The magnetic toolface sensor 245 may be or include a conventional or future-developed magnetic toolface sensor which detects toolface orientation relative to magnetic north or true north. The gravity toolface sensor 250 may be or include a conventional or future-developed gravity toolface sensor which detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal to the controller 210 via wired or wireless transmission.

The BHA 170 may also include an MWD weight-on-bit (WOB) sensor 260 that is configured to detect a value or range of values for WOB at or near the BHA 170. The WOB data detected via the MWD WOB sensor 260 may be sent to the controller 210 via one or more signals, such as one or more electronic signals (e.g., wired or wireless transmission) or mud pulse telemetry, or any combination thereof.

The top drive 140 may also or alternatively include one or more sensors or detectors that provide information that may be considered by the controller 210 when it selects the oscillation profile. In this embodiment, the top drive 140 includes a rotary torque sensor 265 that is configured to detect a value or range of the reactive torsion of the quill 145 or drill string 155. The top drive 140 also includes a quill position sensor 270 that is configured to detect a value or range of the rotational position of the quill, such as relative to true north or another stationary reference. The rotary torque and quill position data detected via sensors 265 and 270, respectively, may be sent via electronic signal to the controller 210 via wired or wireless transmission.

The top drive 140 may also include a hook load sensor 275, a pump pressure sensor or gauge 280, a mechanical specific energy (MSE) sensor 285, and a rotary RPM sensor 290.

The hook load sensor 275 detects the load on the hook 135 as it suspends the top drive 140 and the drill string 155. The hook load detected via the hook load sensor 275 may be sent via electronic signal to the controller 210 via wired or wireless transmission.

The pump pressure sensor or gauge 280 is configured to detect the pressure of the pump providing mud or otherwise powering the BHA from the surface. The pump pressure detected by the pump sensor pressure or gauge 280 may be sent via electronic signal to the controller 210 via wired or wireless transmission.

The mechanical specific energy (MSE) sensor 285 is configured to detect the MSE representing the amount of energy required per unit volume of drilled rock. In some embodiments, the MSE is not directly sensed, but is calculated based on sensed data at the controller 210 or other controller about the apparatus 100.

The rotary RPM sensor 290 is configured to detect the rotary RPM of the drill string. This may be measured at the top drive or elsewhere, such as at surface portion of the drill string. The RPM detected by the RPM sensor 290 may be sent via electronic signal to the controller 210 via wired or wireless transmission.

In FIG. 2, the top drive 140 also includes a controller 295 and/or other device for controlling the rotational position, speed and direction of the quill 145 or other drill string component coupled to the top drive 140 (such as the quill 145 shown in FIG. 1). Depending on the embodiment, the controller 295 may be integral with or may form a part of the controller 210.

The controller 210 is configured to receive detected information (i.e., measured or calculated) from the user-interface 205, the BHA 170, and/or the top drive 140, and utilize such information to continuously, periodically, or otherwise operate to determine and identify an oscillation regime target, such as a target rotation parameter having improved effectiveness. The controller 210 may be further configured to generate a control signal, such as via intelligent adaptive control, and provide the control signal to the top drive 140 to adjust and/or maintain the oscillation profile to most effectively perform a drilling operation.

Moreover, as in the exemplary embodiment depicted in FIG. 2, the controller 295 of the top drive 140 may be configured to generate and transmit a signal to the controller 210. Consequently, the controller 295 of the top drive 140 may be configured to modify the number of rotations in an oscillation, the torque level threshold, or other oscillation regime target. It should be understood the number of rotations used at any point in the present disclosure may be a whole or fractional number.

Figure 3:
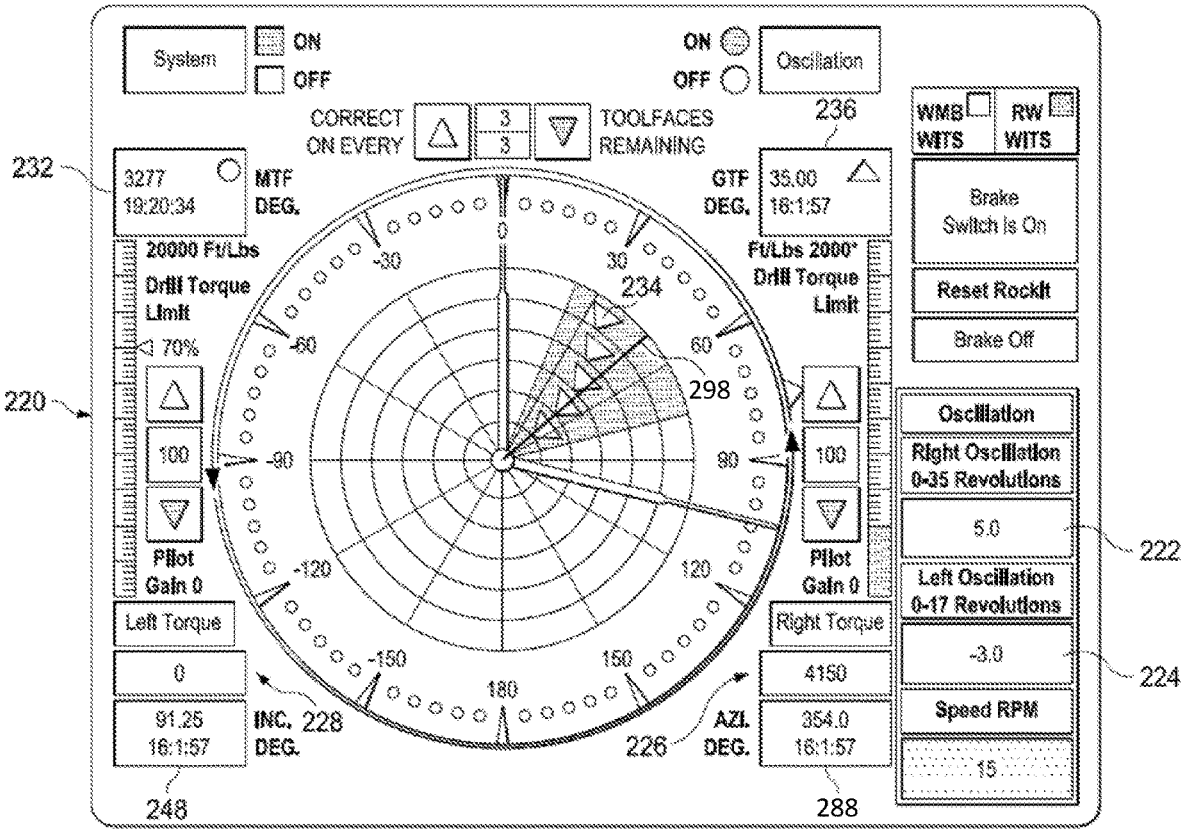
FIG. 3 is a diagram according to one or more aspects of the present disclosure.

FIG. 3 shows a portion of the display 220 that conveys information relating to the drilling process, the drilling rig apparatus 100, the top drive 140, and/or the BHA 170 to a user, such as a rig operator. As can be seen, the display 220 includes a right oscillation amount at 222, shown in this example as 5.0, and a left oscillation amount at 224, shown in this example as −3.0. These values represent the number of revolutions in each direction from a neutral center when oscillating. In a preferred embodiment, the oscillation revolution values are selected to be values that provide a high level of oscillation so that a high percentage of the drill string oscillates, to reduce axial friction on the drill string from the bore wall, while not disrupting the direction of the BHA. In certain embodiments, the right and left oscillation amounts may be determined based on rotational torque (e.g., previously calculated rotational torque).

In this example, the display 220 also conveys information relating to the actual torque. Here, right torque and left torque may be entered in the regions identified by numerals 226 and 228 respectively.

In addition to showing the oscillation rotational or revolution values and oscillation torque, the display 220 also includes a dial or target shape having a plurality of concentric nested rings. In this embodiment, the magnetic-based tool face orientation data is represented by the line 298 and the data 232, and the gravity-based tool face orientation data is represented by symbols 234 and the data 236. The symbols and information may also or alternatively be distinguished from one another via color, size, flashing, flashing rate, shape, and/or other graphic indicator or technique.

In the exemplary display 220 shown in FIG. 3, the display 220 includes a historical representation of the tool face measurements, such that the most recent measurement and a plurality of immediately prior measurements are displayed. However, in other embodiments, the symbols may indicate only the most recent tool face and quill position measurements.

The display 220 may also include a textual and/or other type of indicator 248 displaying the current or most recent inclination of the remote end of the drill string. The display 220 may also include a textual and/or other type of indicator 250 displaying the current or most recent azimuth orientation of the remote end of the drill string. Additional selectable buttons, icons, and information may be presented to the user as indicated in the exemplary display 220. Additional details that may be included include those disclosed in U.S. Pat. No. 8,528,663 to Boone, which is incorporated herein by express reference thereto.

Figure 4:
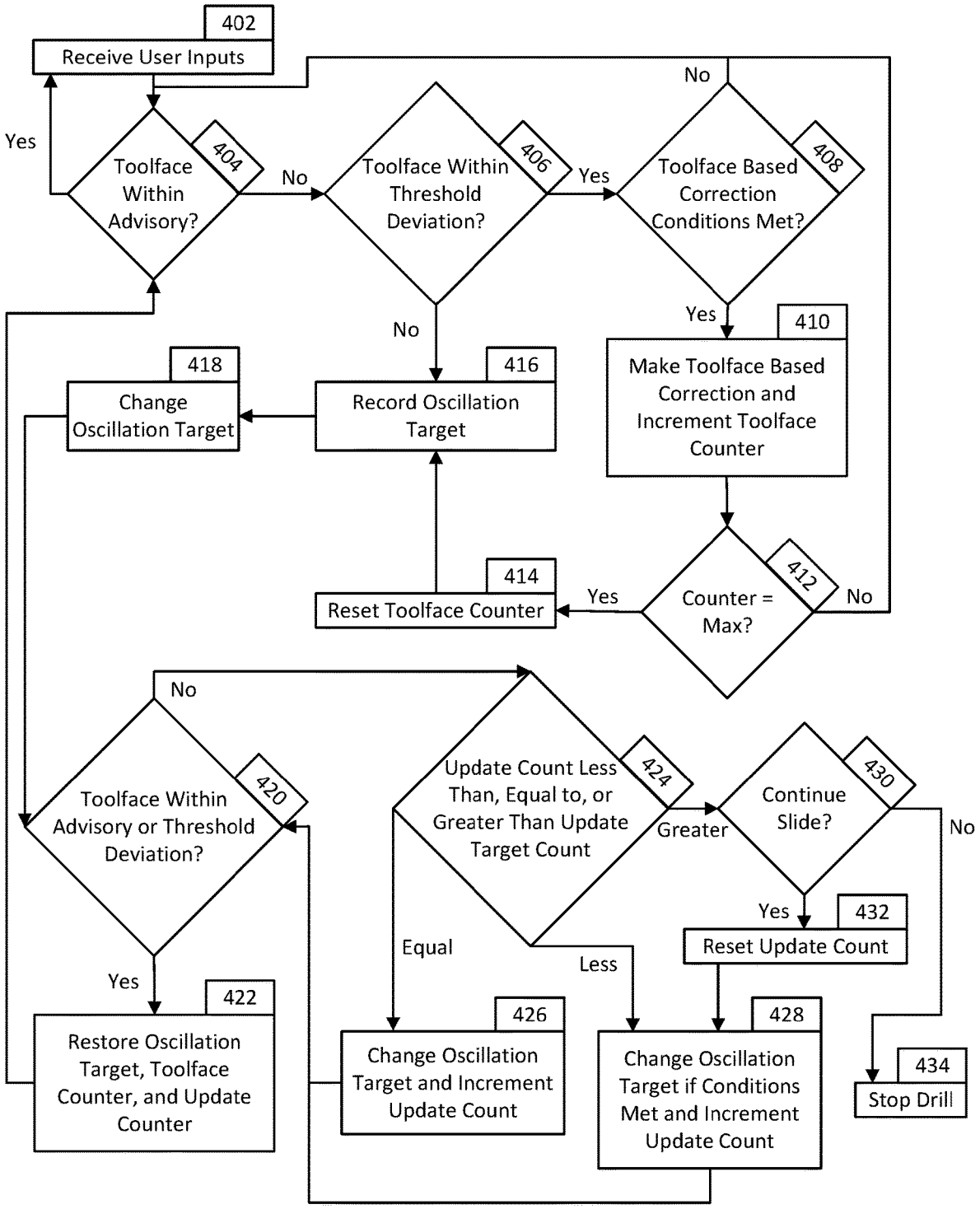
FIG. 4 is a flow-chart diagram of at least a portion of a method according to one or more aspects of the present disclosure.

FIG. 4 is a flow chart showing an exemplary method for automated steering of an oscillation regime while slide drilling. The method illustrated in FIG. 4 may be used to, at least, automatically adjust the right and left oscillation rotational or revolution values (e.g., by one or more of the controllers described herein) to provide faster toolface manipulation and improved control while drilling (e.g., while directional drilling).

The method illustrated in FIG. 4 may commence at step 402. In step 402, user inputs directed towards one or more operating parameters are received. Such parameters may include, for example, one or more rotational or revolution values (e.g., right and left oscillation rotational or revolution values), a target toolface orientation, toolface based correction conditions, or other parameters that may be controlled or determined through user inputs. Toolface based correction conditions may be conditions that, when met, result in the one or more controllers providing updated instructions to one or more components of the apparatus 100 or conditions and/or thresholds for determining that such conditions are met. Such counters or thresholds may include, for example, a maximum toolface correction count, a toolface correction count, an oscillation target update count, a number of toolface cycles to wait, and/or other such counters or thresholds that may be described in further detail herein.

After step 402, the method may proceed to step 404. In step 404, the toolface orientation may be compared to a toolface advisory. The toolface advisory may be a recommended toolface orientation. In certain embodiments, the toolface advisory may be an orientation range (e.g., any toolface orientation within the orientation range may be within the toolface advisory). As such, the toolface advisory may be, for example, a preferred angular zone or toolface orientation that the driller or automated drilling program may aim to keep the toolface orientation or toolface readings within. In certain embodiments, the toolface advisory may be a range of orientations around a single value target toolface orientation. In other embodiments, the target toolface orientation may be a range of angles and the toolface advisory may be such a range. In yet another embodiment, the target toolface orientation may be a range of angles and the toolface advisory may be a range of orientations around the range.

If the toolface orientation is within the toolface advisory, the method may return to step 402 and receive additional user inputs and/or may continue to monitor the toolface readings. If the toolface orientation is outside the toolface advisory, the method may proceed to step 406. In step 406, the toolface orientation may be checked to determine if the toolface orientation is within a threshold deviation. The threshold deviation may be a single deviation value and/or a range of values. In certain embodiments, the threshold deviation may be determined and/or determined in step 402. For example, the threshold deviation of certain embodiments may be a deviation of between 25 to 75 degrees (e.g., 50 degrees) from the target toolface orientation. The threshold deviation may be an orientation or orientations around the toolface advisory (e.g., around one or both sides of the toolface advisory) and greater than the toolface advisory.

If the toolface orientation in step 406 is within the threshold deviation, the method may proceed to step 408. Otherwise, the method may proceed to step 416.

In step 408, the one or more controllers may determine if one or more toolface based correction conditions are met. In certain embodiments, toolface orientation data may be periodically communicated to the one or more controllers through one or more data cycles and the one or more controllers may determine the toolface orientation from such data. The toolface based correction conditions may include, for example, determining whether a sufficient number of data cycles indicating that the toolface orientation is outside the toolface advisory, but within the threshold deviation, has been received. In certain embodiments, the toolface based correction condition may determine that a sufficient number of data cycles indicating that the toolface orientation is outside the advisory has been received in a row (e.g., that the last two or more such data cycles received both or all indicate that the toolface orientation is outside the toolface advisory). The number of data cycles may be tracked by, for example, a data cycle counter within the one or more controllers and the data cycle counter may be compared to the number of data cycles (received continuously or a number of which is received within a total number of cycles, such as four within the last five cycles) received indicating that the toolface orientation is outside the toolface advisory.

If the toolface based correction conditions are met, the method may proceed to step 410. In step 410, a toolface based correction may be communicated by the one or more controllers. The toolface based correction may be, for example, any correction that does not change settings related to operating the drill string 155. As such, the toolface based correction may include changes to one or more instructions for operating the drill pipe 165, the BHA 170, and/or other components of the apparatus 100. Additionally, in certain examples, the toolface correction counter may be incremented to indicate that an additional toolface based correction has been performed.

The method may then move to step 412. In step 412, the toolface correction counter may be compared to a maximum toolface correction count. If the toolface correction counter is equal to the maximum toolface correction count, the toolface correction counter may be reset in step 414 (e.g., zeroed) and then the method may proceed to step 416. Otherwise, the method may revert back to step 404 to check whether the toolface orientation is within the toolface advisory.

In step 416, the current oscillation targets may be recorded and/or stored. The oscillation targets may include parameters associated with the operation of the drill string 155 such as, for example, one or more rotational or revolution values (e.g., right and left oscillation rotational or revolution values) or other parameters. The current oscillation targets may be recorded and/or stored within a memory of the one or more controllers.

After step 416, the method may proceed to step 418. In step 418, the oscillation targets may be changed. Changing the oscillation targets may include changing one or more of the rotational or revolution values (e.g., right and left oscillation rotational or revolution values) or other parameters related to operation of the drill string 155. As an illustrative example, the target rotational or revolution values may be changed by 0.25-1.75 revolutions towards the target toolface orientation. As such, an additional 0.5 revolutions or wraps towards the target toolface orientation may be added to the target rotational or revolution value. In certain embodiments, a direction of change (e.g., whether the right or left rotational or revolution values are changed) may be determined. Such a direction of change may be a change that may be determined to help change the toolface orientation towards the target toolface orientation. For example, the target rotational or revolution values may be increased by, e.g., 0.5 revolutions using the shortest distance towards the target direction as the determining factor (e.g., would follow the 180 degree rule). As such, if the toolface is 150 degrees left of the target toolface and, thus, 210 degrees right of the target toolface, the oscillation to the left of the toolface would be increased towards the target.

The method may then proceed to step 420. In step 420, the one or more controllers may determine if the toolface orientation is within the toolface advisory or within the threshold deviation. The one or more controllers may make such a determination after a set number of toolface cycles has passed since the previous step of the method (e.g., in certain embodiments, the previous step may be one of steps 418, 426, or 428). The set number of toolface cycles in step 420 may be entered by a user in step 402 or determined in another manner.

If the toolface orientation is within the toolface advisory or within the threshold deviation, the method may proceed to step 422. If the toolface orientation is not within the toolface advisory or not within the threshold deviation, the method may proceed to step 424.

In step 422, upon determining that the toolface orientation is within the toolface advisory or within the threshold deviation, the oscillation targets recorded and/or stored in step 416 may be restored (e.g., re-communicated from the one or more controllers to the drill string 155 or components controlling the drill string 155). As such, the drill string 155 may again be driven with settings that include the oscillation targets stored in step 416. The method may then return to step 404.

In step 424, an oscillation target update count may be compared to an update target count. The oscillation target update count may be a count indicating the number of times that the oscillation targets have been changed. In some embodiments, the oscillation target update count may track oscillation target changes performed in one or more of steps 418, 426, and 428. The update target count may be entered by a user in step 402 and may be a threshold count that the update count is compared against. Certain embodiments of the method may allow for the update target count to be changed while the method is performed. If the oscillation target update count is equal to the update target count, the method may proceed to step 426. If the oscillation target update count is less than the update target count, the method may proceed to step 428. If the oscillation target update count is greater than the update target count, the method may proceed to step 430.

In step 426, the oscillation target may be changed and the oscillation target update count may be incremented. The oscillation target may be changed so that the target rotational or revolution values may be changed by removing 0.25-2.0 revolutions or wraps (e.g., 1.0 revolutions or wraps) from a direction opposite that of the target toolface orientation. The method may then return to step 420.

In step 428, the oscillation target may be changed and the oscillation target update count may be incremented. The oscillation target change in step 428 may be different than the oscillation target change in step 426. In certain embodiments, before the oscillation target is changed in step 428, the one or more controllers may determine if change conditions are met. The change conditions may include, for example, if the toolface orientation deviates from the target toolface orientation by greater than a threshold amount (e.g., deviates by 30 degrees or more, such as 50 degrees) and/or that the oscillation target change performed in step 418 has resulted in a toolface orientation change greater than, equal to, or less than a threshold change amount (e.g., the oscillation target change performed in step 418 has changed the toolface orientation by less than 30 degrees towards the target toolface orientation).

If the change conditions are met, the oscillation target may be changed. In certain examples, the oscillation target may be changed by adding 0.25-1.75 revolutions (e.g., 0.5 revolutions or wraps) towards the target toolface orientation. The method may then return to step 420.

In step 430, the display 220 and/or another such user interface (e.g., an interface that may communicate with visual, audible, haptic, and/or message formats) may alert the driller for a decision as to whether to continue drilling. If the driller provides a response indicating that drilling will cease, the method may proceed to step 434 and drilling may be stopped. If the driller provides a response indicating that drilling will continue, the method may proceed to step 432. In step 432, the update target count may be reset (e.g., zeroed) and then the method may proceed to step 428.

Accordingly, the method may illustrate a technique for automated steering to manipulate toolface position. The method described herein may be automatically performed by one or more controllers of the apparatus 100 and may allow for faster toolface manipulation as compared to, for example, manual operation by a driller. Additionally, the method described herein may allow for improved control that may allow for drilling more closely conforms to the target toolface orientation.

Figure 5:
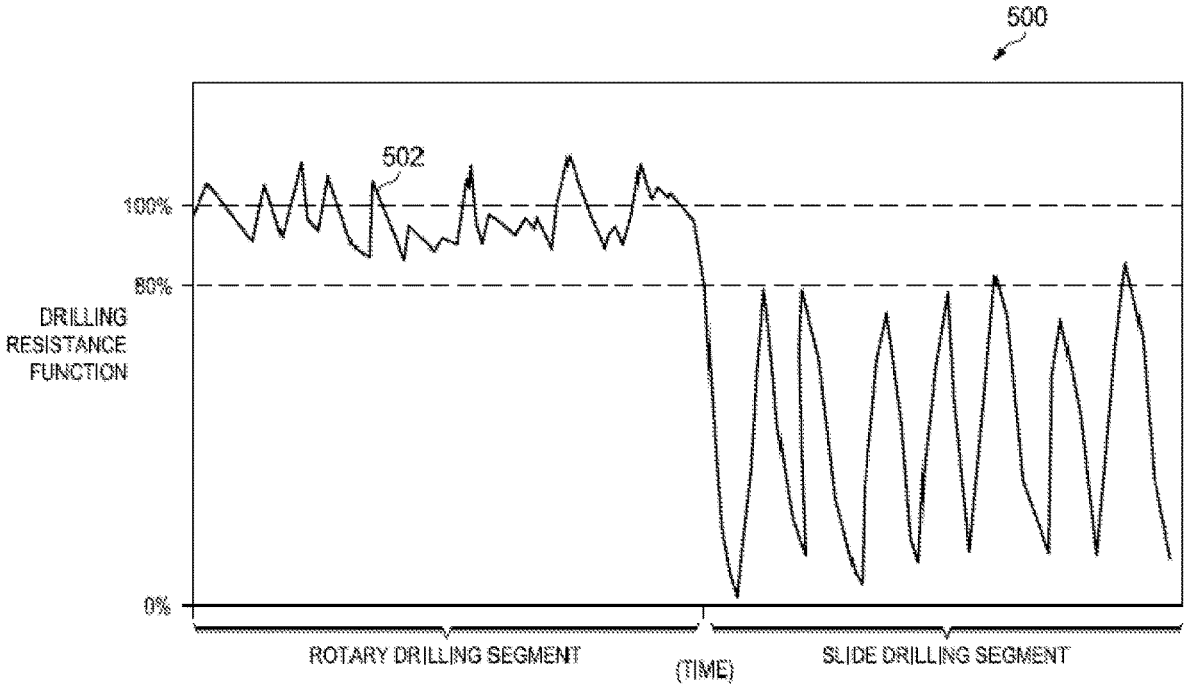
FIG. 5 is a diagram according to one or more aspects of the present disclosure.

FIG. 5 is an exemplary graph 500 showing the representative drilling resistance function 502 during a rotary drilling period. This information is used to determine a recommended oscillation revolution value for both the right and left rotations during a slide drilling procedure that follows. Referring to FIG. 5, the graph 500 includes a drilling resistance function 502 along the y-axis representing the calculated representative value. The x-axis represents time including a rotary drilling segment or period followed immediately thereafter by a slide drilling segment or period.

The exemplary chart of FIG. 5 shows the drilling resistance function over time during the rotary drilling segment. In this example, the drilling resistance function is relatively stable during the rotary drilling segment. As indicated above, the rotary drilling segment may be a period of time immediately prior to a slide and may be any period of time, and may be, for example, an amount of time in the range of about 20 minutes to about 90 minutes. It also may be the time taken to accomplish a task, such as to advance a stand. The controller 210 may process and output the drilling resistance function in real-time during drilling so as to have a real-time output. In other examples, the data from all sensors is saved and averaged, and the controller may then provide a single drilling resistance function for a time period of the rotary drilling segment.

In this chart in FIG. 5, the controller 210 assigns an average value to the drilling resistance function over the designated time period, which in this example, for explanation only, is shown as 100%.

In certain embodiments, the controller 210 may, after processing the received information to generate a drilling resistance function, output a new oscillation revolution value based on the received feedback data. For example, based on the drilling resistance function shown in FIG. 5, the controller 210 may be configured to output a recommended number of right oscillation revolutions and a number of left oscillation revolutions. The right and left oscillation revolution numbers may be selected to be revolution values that provide rotation to a relatively high percentage of the drill pipe while not disrupting the direction of the BHA. Because of this, frictional resistance is minimized, while maintaining a low risk or no risk of moving the BHA off course during the slide drilling. To make this selection, the controller 210 may include a table that provides an oscillation revolution value based solely on the drilling resistance function. In some embodiments, the controller 210 may include multiple tables that correspond to the drilling resistance function and additional factors.

In some embodiments, the controller 210 outputs the oscillation revolution values to the user-interface 205, and the values on the display, such as the display 220 in FIG. 3, are automatically updated. In other embodiments, the controller 210 makes recommendations to the operator through the display 220 or other elements of the user-interface 205. When recommendations are made, the operator may choose to accept or decline the recommendations or may make other adjustments, for example, to move the oscillation revolution values closer to the recommended values. In the examples shown, the oscillation revolution values may be, for example, and without limitation, in the range of 0-35 revolutions to the right and 0-17 revolutions to the left. Other ranges and values are contemplated. In some examples, the recommended right and left oscillation values are different (or asymmetric), while in others they are the same (or symmetric). By operating at the recommended oscillation revolution values, the slide drilling procedure may be made more efficient by reducing the amount of friction on the drill string while still having low risk of moving the BHA off course.

For explanation only, the slide drilling segment is shown in FIG. 5 immediately following the rotary drilling segment. Here, the recommended oscillation revolution values are such that the drilling resistance function, measured during the slide drilling segment, has a target peak range of about 70% to 80% of the average drilling resistance function taken during the rotary drilling segment time period immediately preceding the slide drilling segment. For example, a target range of about 10.2 oscillation revolutions to the right and 7.9 oscillation revolutions to the left may provide a peak drilling resistance function in a desired range. In FIG. 5, the right and left oscillations appear as spikes in the drilling resistance function during the time period of the slide drilling segment. In other instances, the target peak range is about 80% of the average drilling resistance function taken during the rotary drilling segment and in yet others, the target range is greater than about 50% of the average drilling resistance function taken during the rotary drilling segment.

In some embodiments, the drilling resistance function is monitored during a slide drilling procedure. It may also be taken into account, along with the drilling resistance function, to determine the recommended oscillation revolution values for a subsequent slide drilling procedure. For example, with reference to FIG. 5, the slide drilling segment may be monitored and compared to a threshold determined by the controller. In this example, the threshold is 80% of the average drilling resistance function during the rotary drilling segment. Depending on the embodiment, the 80% threshold may be a ceiling, may be a floor, or may be a target range for the drilling resistance function during the slide drilling segment. By monitoring the drilling resistance function during a slide drilling procedure, the controller 210 may recommend oscillation values taking into account all available information. Accordingly, as the BHA proceeds through different subterranean formations, the system may respond by modifying or adapting the approach to address increases or decreases in wellbore resistance for each slide.

While the above method is described to automatically determine a target range of rotational oscillation, the systems and methods described herein also contemplate using the drilling resistance function to determine a target range, threshold, ceiling or floor for any oscillation regime target, including a torque limit used to control the amount of oscillation. Accordingly, the description herein applies equally to other oscillation regimes. For example, it can determine a target torque to be achieved when rotating right and a target torque to be achieved when rotating left. This target may then be input into the controller to provide a more effective operation to increase the effectiveness of slide drilling.

By using the systems and method described herein, a rig operator can more easily operate the rig during slide drilling at a maximum efficiency to save time and reduce drilling costs.

In view of all of the above and the figures, one of ordinary skill in the art will readily recognize that the present disclosure introduces an apparatus that may include a drilling tool comprising at least one measurement while drilling instrument, a user interface, and a controller communicatively connected to the drilling tool and configured to receive drilling data from the drilling tool, determine that a toolface orientation of the drilling tool is outside an advisory sector, record a first oscillation target for the drilling tool, wherein the first oscillation target comprises at least a clockwise rotation target and a counterclockwise rotation target, determine an updated oscillation target, where at least one of the clockwise rotation target or counterclockwise rotation target of the updated oscillation target is different from the clockwise rotation target or the counterclockwise rotation target of the first oscillation target, and provide the updated oscillation target to the drilling tool.

In an aspect of the invention, the controller may be further configured to determine, from at least the drilling data, that the toolface orientation of the drilling tool is greater than a threshold deviation from a target toolface orientation, where the recording the first oscillation target and the determining the updated oscillation target is responsive to determining that the toolface orientation is greater than the threshold deviation.

In another aspect of the invention, the controller may be further configured to determine, from at least the drilling data, that the toolface orientation of the drilling tool is less than a threshold deviation from a target toolface orientation, provide a toolface based correction to the drilling tool, and increment a toolface correction counter responsive to providing the toolface based correction. In certain such aspects, the controller may be further configured to determine that the toolface correction counter is equal to or greater than a maximum toolface correction count, where the recording the first oscillation target and the determining the updated oscillation target is responsive to determining that the toolface correction counter is equal to or greater than the maximum toolface correction count.

In another aspect of the invention, determining the updated oscillation target includes determining a direction of change. In certain such aspects, determining the updated oscillation target includes changing the clockwise rotation target and/or the counterclockwise rotation target by 0.25-1.75 revolutions in the direction of change.

In another aspect of the invention, the controller may be further configured to determine, from at least the drilling data, that an updated toolface orientation of the drilling tool is less than a threshold deviation from a target toolface orientation and/or that the toolface orientation of the drilling tool is within the advisory sector, and provide the first oscillation target to the drilling tool. In certain such aspects, at least the determining the updated toolface orientation is performed after a preset number of toolface cycles.

In another aspect of the invention, the controller may be further configured to determine, from at least the drilling data, that an updated toolface orientation of the drilling tool is greater than a threshold deviation from a target toolface orientation and that the toolface orientation of the drilling tool is outside the advisory sector, and determine an oscillation target update count. In certain such aspects, the controller may be further configured to determine that the oscillation target update count is less than an update target count, determine that the toolface orientation of the drilling tool is greater than the threshold deviation and that the toolface orientation changed less than 30 degrees responsive to the updated oscillation target, determine a further updated oscillation target, wherein at least one of the clockwise rotation target or counterclockwise rotation target of the further updated oscillation target is different, and increase the oscillation target update count. In certain additional aspects, the controller may be further configured to determine that the oscillation target update count is equal to an update target count, determine a further updated oscillation target, wherein at least one of the clockwise rotation target or counterclockwise rotation target of the further updated oscillation target is different, and increase the oscillation target update count. In another such aspect, the controller may be further configured to determine that the oscillation target update count is greater than an update target count, and communicate a continue slide request via the user interface.

In another aspect of the invention, a method may be introduced that may include receiving drilling data from a drilling tool, determining that a toolface orientation of the drilling tool is outside an advisory sector, recording a first oscillation target for the drilling tool, wherein the first oscillation target comprises at least a clockwise rotation target and a counterclockwise rotation target, determining an updated oscillation target, wherein at least one of the clockwise rotation target or counterclockwise rotation target of the updated oscillation target is different from the clockwise rotation target or the counterclockwise rotation target of the first oscillation target, and providing the updated oscillation target to the drilling tool.

In another aspect of the invention, the method may further include determining, from at least the drilling data, that the toolface orientation of the drilling tool is greater than a threshold deviation from a target toolface orientation, where the recording the first oscillation target and the determining the updated oscillation target is responsive to determining that the toolface orientation is greater than the threshold deviation. In certain such aspects, the method may further include determining, from at least the drilling data, that the toolface orientation of the drilling tool is less than a threshold deviation from a target toolface orientation, providing a toolface based correction to the drilling tool, and incrementing a toolface correction counter responsive to providing the toolface based correction. In another such aspect, the method may further include determining that the toolface correction counter is equal to or greater than a maximum toolface correction count, where the recording the first oscillation target and the determining the updated oscillation target is responsive to determining that the toolface correction counter is equal to or greater than the maximum toolface correction count.

In another aspect of the invention, determining the updated oscillation target comprises determining a direction of change. In certain such aspects, determining the updated oscillation target may include changing the clockwise rotation target and/or the counterclockwise rotation target by 0.25-1.75 revolutions in the direction of change.

In another aspect of the invention, the method may further include determining, from at least the drilling data, that an updated toolface orientation of the drilling tool is less than a threshold deviation from a target toolface orientation and/or that the toolface orientation of the drilling tool is within the advisory sector, and providing the first oscillation target to the drilling tool. In certain such aspects, at least the determining the updated toolface orientation is performed after a preset number of toolface cycles.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. An apparatus comprising:

a drilling tool comprising at least one measurement while drilling (MWD) instrument;

a user interface; and a controller communicatively connected to the drilling tool and configured to:

receive drilling data from the drilling tool, wherein the drilling data includes a current toolface orientation;

determine that the current toolface orientation of the drilling tool is outside an advisory sector;

record a first oscillation target for the drilling tool, wherein the first oscillation target comprises at least a clockwise rotation target comprising a first number of revolutions in a clockwise direction and a counterclockwise rotation target comprising a second number of revolutions in a counterclockwise direction;

determine an updated oscillation target, wherein a clockwise rotation target of the updated oscillation target comprises a third number of revolutions in a clockwise direction, or a counterclockwise rotation target of the updated oscillation target comprises a fourth number of revolutions in a counterclockwise direction;

determine a number of times the first oscillation target has been updated;

determine that the number of times the first oscillation target has been updated is less than or equal to a threshold number; and provide the updated oscillation target to the drilling tool.

2. The apparatus of claim 1, wherein the controller is further configured to:

determine, from at least the drilling data, that the current toolface orientation of the drilling tool is greater than a threshold deviation from a target toolface orientation, wherein the recording the first oscillation target and the determining the updated oscillation target is responsive to determining that the current toolface orientation is greater than the threshold deviation.

3. The apparatus of claim 1, wherein the controller is further configured to:

determine, from at least the drilling data, that the current toolface orientation of the drilling tool is less than a threshold deviation from a target toolface orientation;

provide a toolface based correction to the drilling tool; and increment a toolface correction counter responsive to providing the toolface based correction.

4. The apparatus of claim 3, wherein the controller is further configured to:

determine that the toolface correction counter is equal to or greater than a maximum toolface correction count, wherein the recording the first oscillation target and the determining the updated oscillation target is responsive to determining that the toolface correction counter is equal to or greater than the maximum toolface correction count, and wherein the first oscillation target is recorded to be stored and used as an oscillation target after the current toolface orientation is corrected to within the advisory sector.

5. The apparatus of claim 1, wherein determining the updated oscillation target comprises determining a direction of change, wherein the direction of change is determined according to a shortest direction towards the clockwise rotation target or the counterclockwise rotation target.

6. The apparatus of claim 5, wherein determining the updated oscillation target comprises changing the clockwise rotation target and/or the counterclockwise rotation target by 0.25-1.75 revolutions in the direction of change.

7. The apparatus of claim 1, wherein the controller is further configured to:

determine, from at least the drilling data, that an updated toolface orientation of the drilling tool is less than a threshold deviation from a target toolface orientation and/or that the current toolface orientation of the drilling tool is within the advisory sector; and provide the first oscillation target to the drilling tool.

8. The apparatus of claim 7, wherein at least the determining the updated toolface orientation is performed after a preset number of toolface cycles.

9. The apparatus of claim 1, wherein the controller is further configured to:

determine, from at least the drilling data, that an updated toolface orientation of the drilling tool is greater than a threshold deviation from a target toolface orientation and that the current toolface orientation of the drilling tool is outside the advisory sector.

10. The apparatus of claim 9, wherein the controller is further configured to:

determine that the current toolface orientation of the drilling tool is greater than the threshold deviation and that the current toolface orientation changed less than 30 degrees responsive to the updated oscillation target;

determine a further updated oscillation target, wherein at least one of the clockwise rotation target or counterclockwise rotation target of the further updated oscillation target is different; and increase the number of times the first oscillation target has been updated.

11. The apparatus of claim 9, wherein the controller is further configured to:

determine a further updated oscillation target, wherein at least one of the clockwise rotation target or counterclockwise rotation target of the further updated oscillation target is different; and increase the number of times the first oscillation target has been updated.

12. A method comprising:

receiving drilling data from a drilling tool, wherein the drilling data includes a current toolface orientation;

determining that the current toolface orientation of the drilling tool is outside an advisory sector;

recording a first oscillation target for the drilling tool, wherein the first oscillation target comprises at least a clockwise rotation target comprising a first number of revolutions in a clockwise direction and a counterclockwise rotation target comprising a second number of revolutions in a counterclockwise direction;

determining an updated oscillation target, wherein a clockwise rotation target of the updated oscillation target comprises a third number of revolutions in a clockwise direction, or a counterclockwise rotation target of the updated oscillation target comprises a fourth number of revolutions in a counterclockwise direction;

determining a number of times the first oscillation target has been updated;

determining that the number of times the first oscillation target has been updated is less than or equal to a threshold number; and providing the updated oscillation target to the drilling tool.

13. The method of claim 12, further comprising:

determining, from at least the drilling data, that the current toolface orientation of the drilling tool is greater than a threshold deviation from a target toolface orientation, wherein the recording the first oscillation target and the determining the updated oscillation target is responsive to determining that the current toolface orientation is greater than the threshold deviation.

14. The method of claim 12, further comprising:

determining, from at least the drilling data, that the current toolface orientation of the drilling tool is less than a threshold deviation from a target toolface orientation;

providing a toolface based correction to the drilling tool; and incrementing a toolface correction counter responsive to providing the toolface based correction.

15. The method of claim 14, further comprising:

determining that the toolface correction counter is equal to or greater than a maximum toolface correction count, wherein the recording the first oscillation target and the determining the updated oscillation target is responsive to determining that the toolface correction counter is equal to or greater than the maximum toolface correction count, and wherein the first oscillation target is recorded to be stored and used as an oscillation target after the current toolface orientation is corrected to within the advisory sector.

16. The method of claim 12, wherein determining the updated oscillation target comprises determining a direction of change and wherein the direction of change is determined according to a shortest direction towards the clockwise rotation target or the counterclockwise rotation target.

17. The method of claim 16, wherein determining the updated oscillation target comprises changing the clockwise rotation target and/or the counterclockwise rotation target by 0.25-1.75 revolutions in the direction of change.

18. The method of claim 12, further comprising:

determining, from at least the drilling data, that an updated toolface orientation of the drilling tool is less than a threshold deviation from a target toolface orientation and/or that the current toolface orientation of the drilling tool is within the advisory sector; and providing the first oscillation target to the drilling tool.

19. The method of claim 18, wherein at least the determining the updated toolface orientation is performed after a preset number of toolface cycles.

20. The method of claim 12, wherein the updated oscillation target comprises the clockwise rotation target of the updated oscillation target and the counterclockwise rotation target of the updated oscillation target, the third number of revolutions is the same as the fourth number of revolutions, and the third number of revolutions is different than the first number of revolutions or the second number of revolutions.

* * * * *